US010819041B1

(12) United States Patent
Kee et al.

(10) Patent No.: US 10,819,041 B1
(45) Date of Patent: Oct. 27, 2020

(54) DUAL-POLARIZED APERTURE-COUPLED PATCH ANTENNA ARRAY WITH HIGH ISOLATION

(71) Applicant: LOCKHEED MARTIN CORPORATION, Bethesda, MD (US)

(72) Inventors: Andrew Jason Kee, Arvada, CO (US); Arun Kumar Bhattacharyya, Rancho Palos Verdes, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 16/054,865

(22) Filed: Aug. 3, 2018

(51) Int. Cl.
*H01Q 21/06* (2006.01)
*H01Q 9/04* (2006.01)

(52) U.S. Cl.
CPC ..... *H01Q 21/065* (2013.01); *H01Q 9/0428* (2013.01); *H01Q 21/064* (2013.01)

(58) Field of Classification Search
CPC ... H01Q 21/065; H01Q 21/064; H01Q 9/0428
See application file for complete search history.

(56) References Cited

U.S. PATENT DOCUMENTS 5,907,305 A * 5/1999 Epp ..... H01Q 1/248 343/700 MS
2003/0043074 A1* 3/2003 Bhattacharyya ..... H01Q 21/065 343/700 MS
2018/0102594 A1* 4/2018 Murdock ..... H01Q 21/065

OTHER PUBLICATIONS

Wang et al., "Design of a Dual-Polarized Patch Array for Millimeter-Wave Applications," IEEE 2016, 4 pages.
Fang et al., "Dual polarised aperture-coupled patch antenna using asymmetrical feed," IET Microwaves, Antennas & Propagation, 2015, vol. 9, Iss 13, pp. 1399-1406.
Xie et al., "Wideband dual-polarised electromagnetic-fed patch antenna with high isolation and low cross-polarisation," Electronics Letters, Jan. 2013, vol. 49, No. 3, 2 pages.

* cited by examiner

*Primary Examiner* — Hai V Tran
*Assistant Examiner* — Michael M Bouizza
(74) *Attorney, Agent, or Firm* — Morgan, Lewis & Bockius LLP

(57) ABSTRACT

An antenna system includes an antenna array including a number of antenna elements disposed on a substrate. Each antenna element includes a radiation layer, a ground plane layer, a feed layer and an additional ground plane layer. The ground plane layer includes a ground plane conductive layer that has a number of slots. The feed layer includes a feed structure to excite the slots. A dual polarization feature of the antenna array is realized via the slots, and the slots are separated by the ground plane conductive layer.

20 Claims, 6 Drawing Sheets

DUAL-POLARIZED APERTURE-COUPLED PATCH ANTENNA ARRAY WITH HIGH ISOLATION

STATEMENT REGARDING FEDERALLY SPONSORED RESEARCH OR DEVELOPMENT

Not applicable

FIELD OF THE INVENTION

The present invention generally relates to radio-frequency (RF) communication, and more particularly to a dual-polarized aperture-coupled patch antenna array with high isolation.

BACKGROUND

In radio frequency (RF) applications, antennas are used in communication systems to wirelessly transmit signals from one location to another. There are many different types of antennas, including helical, patch, horn, spiral, and wire antennas. Depending on the application and the desired specifications, one or more types of antennas may be suitable to employ. The list of antenna specifications often includes values for a gain, a polarization, an isolation bandwidth, a size and other specifications.

In satellite communication, dual-polarization antenna systems can increase the capacity of a satellite, because more channels can be accommodated within a given frequency band. In order to improve the signal quality, however, high isolation between the two polarizations may be critical. For instance, for wide-angle scanned arrays, where element size is typically small, the isolation between the two orthogonal ports can be low, whereas for an electrically large element, isolation is generally high. Consequently, the carrier (C) to interference (I) ratio (C/I) can become low. For example, a dual-port probe-fed patch element may provide an isolation of less than 15 dB between the two ports. It is understood that the isolation for a probe-fed patch can be improved using a pair of baluns and/or isolators. The use of baluns and/or isolators, however, may add significant complexity and RF loss and can increase the system weight. For satellite communication applications, the desired C/I is about 25 dB, which requires greater than 25 dB isolation between the two ports.

SUMMARY

According to various aspects of the subject technology, methods and configurations are disclosed for providing a dual-polarized aperture-coupled patch antenna array with high isolation. The disclosed solution allows reducing the size and complexity for a wide-angle scanned array.

In one or more aspects, an antenna system includes an antenna array including a number of antenna elements disposed on a substrate. Each antenna element includes a radiation layer, a ground plane layer and a feed layer, and another ground plane. The ground plane layer includes a ground plane conductive layer that has a number of slots. The feed layer includes a feed structure to excite the slots. A dual polarization feature of the antenna array is realized via the slots, and the slots are separated by the ground plane conductive layer material.

In other aspects, an antenna unit cell includes a radiation layer, a ground plane layer (including slots), a feed layer and another ground plane. The radiation layer includes a radiation patch to propagate radio-frequency (RF) radiation. The ground plane layer includes a ground plane conductive layer having two sets of slots separated by the ground plane conductive layer material. The feed layer includes a feed structure that can be used to separately excite the two sets of slots. The two sets of slots are to realize a dual polarization feature of the antenna unit cell. The two sets of slots are symmetrically positioned on the ground plane layer.

In yet other aspects, a method of providing a dual-polarized patch antenna array includes providing a plurality of antenna elements disposed on a substrate. Each antenna element includes a radiation layer, a ground plane layer and a feed layer, and another ground plane. The radiation layer includes a radiation patch, and the ground plane layer includes a ground plane conductive layer. The ground plane conductive layer includes a number of slots separated by the ground plane conductive layer material. The feed layer includes a feed structure that is configured to excite the slots, and the slots realize the dual polarization feature of the dual-polarized patch antenna array. Further, there can be a lower ground plane to protect the circuitry behind the antenna. The lower ground plane can help transmit the entire power out of the top layer (e.g., the radiation layer), as the backward waves are reflected.

The foregoing has outlined rather broadly the features of the present disclosure so that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

Figure 2:
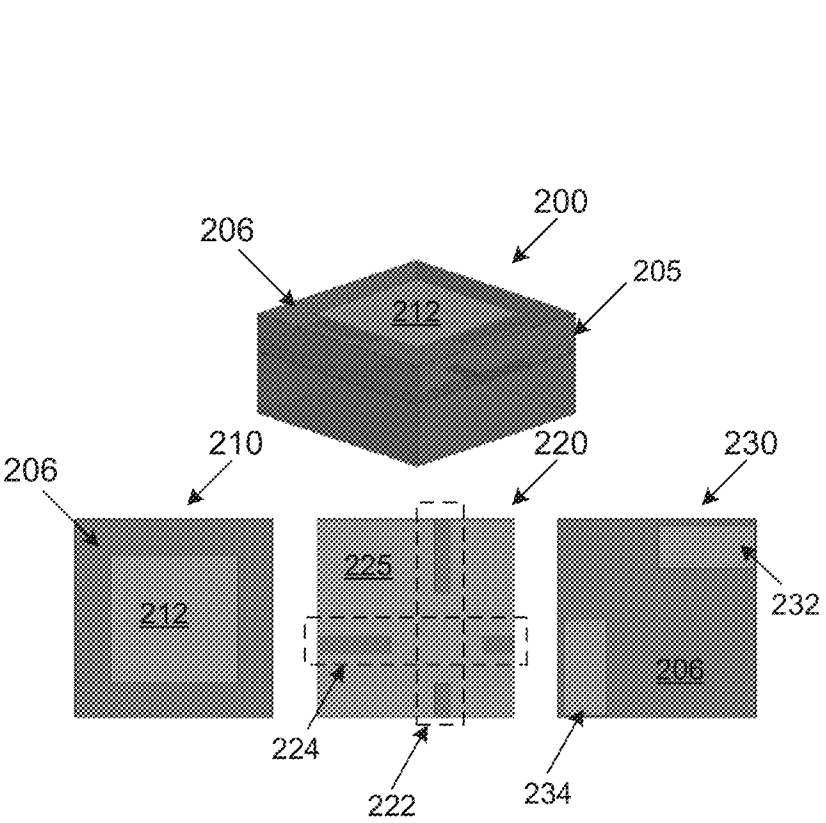
FIG. 2 is a schematic diagram illustrating various views of an example high-isolation dual-polarized aperture-coupled patch antenna element, according to certain aspects of the disclosure.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

According to some aspects of the subject technology, methods and configurations are disclosed for providing a high isolation dual-polarized aperture-coupled patch antenna array. The antenna array of the subject technology is a wide-angle scanned array with reduced size and complexity. Further, the isolation of the antenna array of the subject technology is significantly higher than the isolation between two ports (e.g., about 15 dB) of the conventional dual-polarization antenna systems. The reduced size and complexity and the high isolation between two ports features (e.g., greater than 25 dB) of the disclosed antenna array are desirable in satellite communication applications, where a carrier (C) to interference (I) ratio (C/I) greater than 25 dB is needed.

The high isolation between two linear polarizations is achieved with a patch antenna fed by two orthogonal slots. Each slot provides a single linear polarization, which is fed by one or more feed patches realized on a bottom ground plane that is intended to isolate the underlying circuitry. The antenna of the subject technology is used in an array environment, where the simulations are performed based on an infinite array of patch antennas. The slots for each patch antenna extend out of the unit cell, and each slot is offset from the center of the patch antenna. The offset nature of the slots enhances the isolation (e.g., greater than 30 dB) by increasing the distance between the two orthogonal ports. Conventionally, slot fed patch antennas are center fed, and this can give up to 20 dB of isolation between ports. The offset feed increases the isolation and further helps to improve the return loss of the antenna. The disclosed antenna system can achieve about 15% bandwidth at about 15 dB return loss, compared to 5-10% bandwidth shown for conventional patch antennas. The enhanced bandwidth can be readily scaled to other frequency bands.

Another important aspect of the disclosed array is the scanning angle. When scanning in theta from 0 degrees to 80 degrees, the return loss and isolation can significantly change. In the disclosed antenna array, the return loss can stay better than about 15 dB for theta from 0 degrees to ±35 degrees, and the isolation stays better than about 30 dB for theta from 0 degrees to 25 degrees. These results are good for both 0 and 90 degrees values of the angle phi. The dimensions of the antenna elements including the dimensions of the patch, slot, feed and other dimensions depend on the desired frequency and will be discussed herein.

The existing solutions are either complex stacks including, for example, up to 6 layers of printed circuit boards (PCBs) or cannot achieve greater than 30 dB isolation between the polarizations in an array environment. The high isolations of some of the existing solutions are only for a single element antenna and not for an antenna array capable of beam steering.

Figure 1:
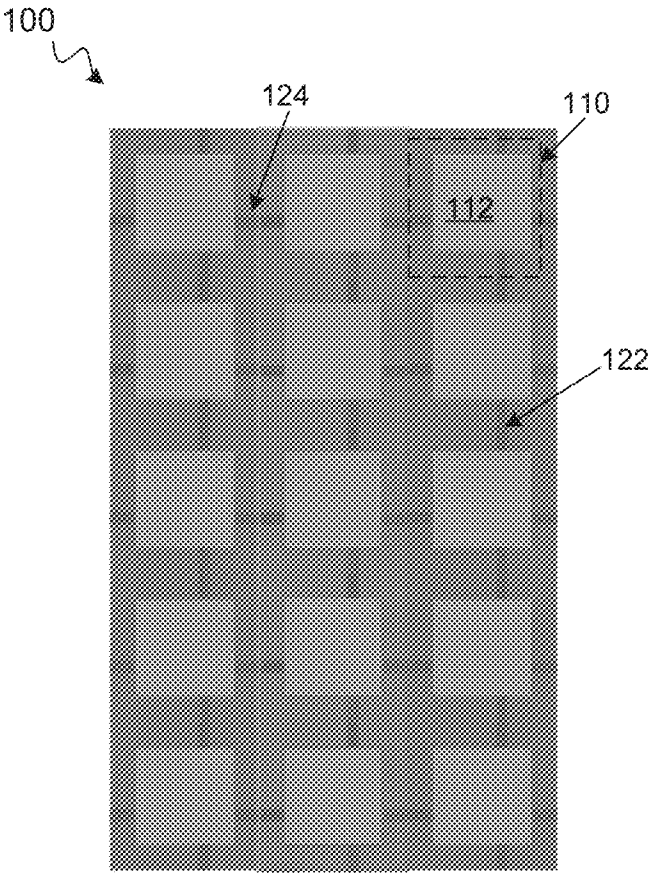
FIG. 1 is a high-level diagram illustrating an example of a high-isolation dual-polarized aperture-coupled patch antenna array, according to certain aspects of the disclosure.

FIG. 1 is a high-level diagram illustrating an example of a high-isolation dual-polarized aperture-coupled patch antenna array 100, according to certain aspects of the disclosure. The diagram in FIG. 1 shows a top view of a high-isolation dual-polarized aperture-coupled patch antenna array 100 (hereinafter "antenna array 100"). The antenna array 100 can include a large number of (e.g., over 100) antenna elements 110 (also referred to as unit cells). The antenna elements 110 can be arranged in various configurations, for example, as a square or rectangular array. The antenna array 100 has a relatively simple structure and can be implemented in a multilayer structure including three substrate layers and four copper layers, as discussed further herein. The antenna array 100 is a compact antenna array and can be realized in small sizes (e.g., a few centimeters). For example, a 200 elements array can be built with dimensions of about 6 cm×12 cm. The small size and reduced complexity and the high isolation between two ports features (e.g., greater than 30 dB) of the antenna array 100 makes it a great candidate for satellite communication applications, in which a C/I greater than 25 dB is required.

Each antenna element 110 has a multilayer structure including three substrate layer and four copper layers, of which the radiation patches 112 and orthogonal slots including vertical slots 122 and horizontal slots 124 are visible in the top view of FIG. 1. Further structural details of the antenna element 110 are discussed below. An important feature of the vertical slots 122 and horizontal slots 124 that is seen in the top view shown FIG. 1 is the extension of the slots beyond each antenna element and joining with the respective slots of the neighboring antenna elements.

FIG. 2 is a schematic diagram illustrating various views 210, 220 and 230 of an example high-isolation dual-polarized aperture-coupled patch antenna element 200, according to certain aspects of the disclosure. The example high-isolation dual-polarized aperture-coupled patch antenna element 200 (hereinafter "antenna element 200") includes the radiation patch 212 on the top layer and a ground plane layer 205 which is isolated from the radiation patch 212 by a substrate material 206. The antenna element 200 is also referred to as an antenna unit cell. In some implementations, the substrate material 206 is a low-loss dielectric material with a relative permittivity of about 2.2. In one or more implementations, the substrate layer 206 can be made of Duroid material.

The top-view 210 of the antenna element 200 shows the radiation patch 212 realized as a conductive plate on the substrate material 206. The radiation patch 212 is square shape but is not limited to the square shape and can have other shapes (e.g., circular, hexagonal or other shapes). In one or more implementations, the radiation patch 212 can be made of a conductive material such as copper, gold, or other metals. In some implementations, a radiation patch made of copper or other metals is plated with gold to protect it from corrosion.

The cross-sectional view 220 of the antenna element 200 shows a ground plane conductive layer 225, in which two sets of orthogonal slots 222 (e.g., vertical slots) and 224 (e.g., horizontal slots) are realized. The two sets of orthogonal slots 222 and 224 extend to edges of the ground plane conductive layer 225, as shown in FIG. 2 and beyond the antenna element 200 (as shown in FIG. 1) and join the respective slots of the neighboring antenna elements. For example, the vertical slots 222 extend out to join vertical slots of two neighboring antenna elements of the antenna array (e.g., on top and bottom sides) and the horizontal slots 224 extend out to join horizontal slots of two neighboring antenna elements of the antenna array (e.g., on right and left sides). In one or more implementations, the ground plane conductive layer 225 is made of a conductive material such as a metal, for example, copper, gold, aluminum and/or other metal layers with suitable conductivity. One interesting feature of the vertical slots 222 and the horizontal slots 224 is their symmetry and their position offset with respect to a center point of the radiation patch 212, as will be discussed later. Each set of the slots 222 and 224 are responsible for a polarization of the dual-polarized antenna. For example, the horizontal slots 224 may be responsible for horizontal polarization and the vertical slots 222 may be responsible for the vertical polarization of a transmit or a receive signal.

The bottom view 230 of the antenna element 200 shows the substrate material 206, on which a feed structure including two feed patches 234 are formed. The stripline feeds patches 232 and 234 are made of a conductive material such as copper, gold, or other metals. In some implementations, a stripline feed made of copper or other metals is plated with gold to protect it from corrosion. Each of the stripline feeds 232 and 234 is a feed port that can be used to feed (e.g., excite) a set of slots. For example, the stripline feed 232 can be used to feed the vertical slots 222, and the feed patch 234 can be used to feed the horizontal slots 224. Each of the stripline feeds 232 and 234 can be connected to a coaxial cable that carries the feed signal (e.g., an RF signal).

Figure 3:
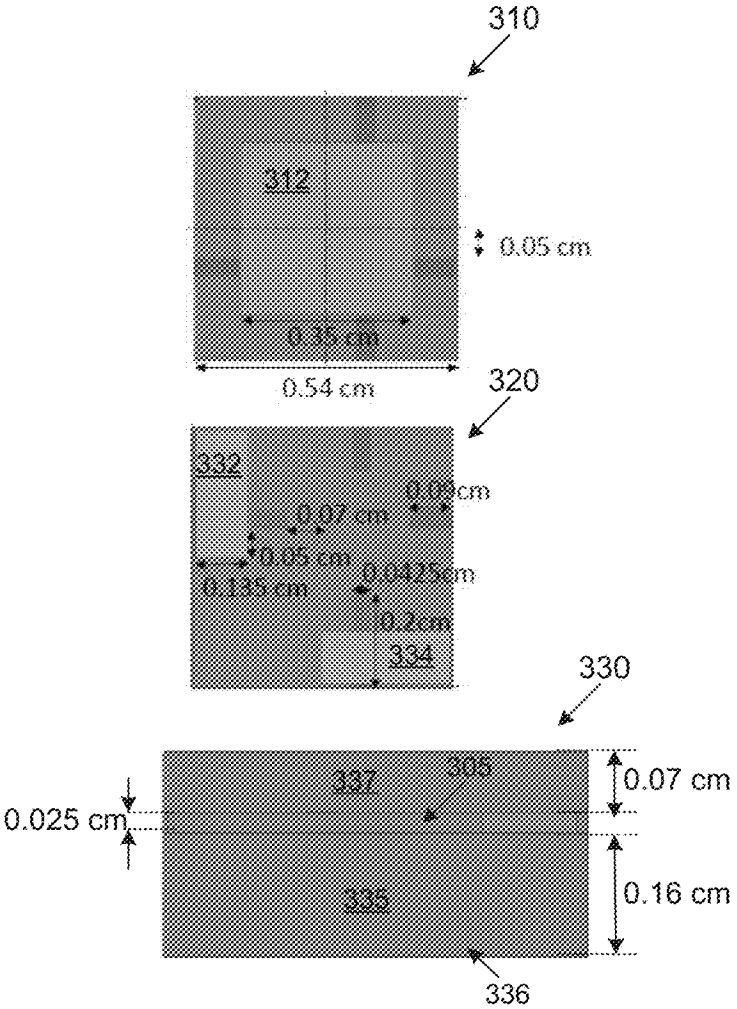
FIG. 3 is a schematic diagram illustrating example dimensions on various views of the high-isolation dual-polarized aperture-coupled patch antenna element of FIG. 2, according to certain aspects of the disclosure.

FIG. 3 is a schematic diagram illustrating example dimensions on various views 310, 320 and 330 of the antenna element 200 of FIG. 2, according to certain aspects of the disclosure. The top view 310 shows an example dimension of about 0.35 cm for the radiation patch 312 (e.g., similar to radiation patch 212 of FIG. 2). An example dimension for each antenna unit cell (e.g., 200 of FIG. 2) is shown to be about 0.54 cm. Example offset values for the positions of the slots (e.g., 222 and 224 of FIG. 2) with respect to a center point of the radiation patch 312 are about 0.05 cm which is about 10% of the unit cell dimensions, although other values may also be acceptable. In one or more implementations, the offset values for the positions of the slots 222 can be different from those of the slots 224.

The cross sectional view 320 shows example values for dimensions of the slots 222 and 224. For example, a width of each of the vertical slots 222 is shown to be about 0.0425 cm, which can be the same as the width of each of the horizontal slots 224. Each set of slots (e.g., vertical slots 222) has a short slot of a length of about 0.09 cm and a long slot of a length of about 0.2 cm. Each of the feed patches 332 and 334 are also shown to have a width of about 0.135 cm. The length of the feed patches 332 and 334 depends on the dimensions of the array element and has to be large enough to have overlaps with the respective slots 222 and 224, in which the overlap shown here is 0.05 cm past the edge of the slot.

The cross-sectional view 330 shows heights of different layers. For example, the thickness of the substrate material separating the stripline feed and the plane slots is shown to be about 0.025 cm, and the height of a substrate layer 335 separating the stripline feeds 332 and 334 from the plane 336 below the substrate layer 335 is about 0.16 cm, and the height of a substrate layer 337 separating a plane above the layer 305, which can include copper, from the radiation patch layer is about 0.07 cm.

Figure 4B:
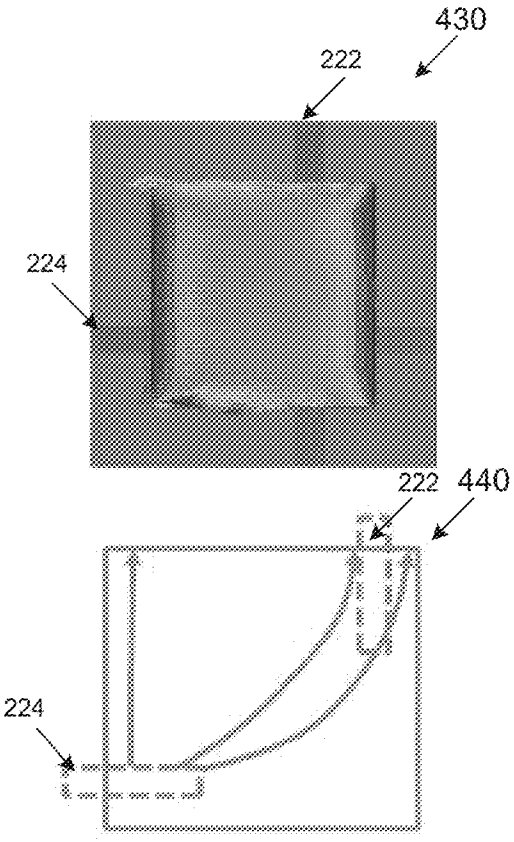
FIGS. 4A-4B are schematic diagrams illustrating high isolation through offset slot feed of the dual-polarized aperture-coupled patch antenna element of FIG. 2, according to certain aspects of the disclosure.
Figure 4A:
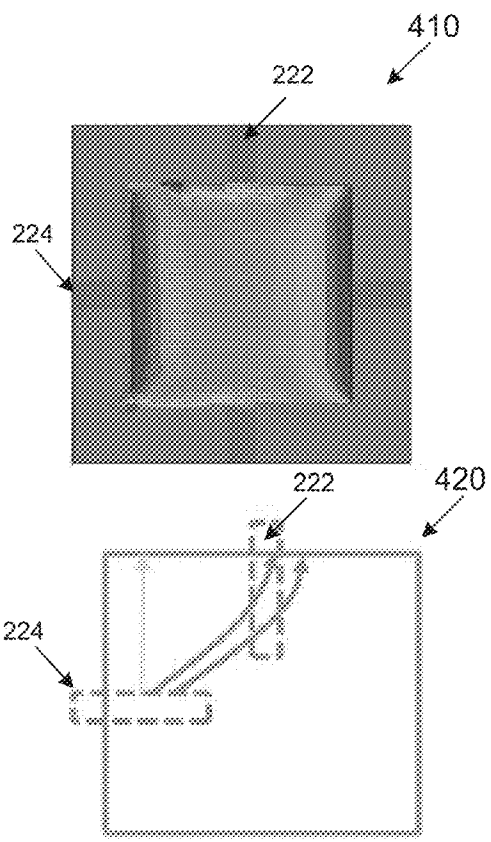

FIGS. 4A-4B are schematic diagrams illustrating high isolation through offset slot feed of the antenna element 200 of FIG. 2, according to certain aspects of the disclosure. The simulation result 410 is for horizontal and vertical slots 224 and 222 that have no offset with respect to the center point of the radiation patch (e.g., 212 of FIG. 2). The result is a higher flow of current from the horizontal slot 224 to the vertical slot 222, due to the short distance between the horizontal slot 224 to the vertical slot 222, as shown in the chart 420.

The simulation result 430 is for horizontal and vertical slots 224 and 222 that each has an offset with respect to the center point of the radiation patch (e.g., 212). The result in this case is a lower flow of current from the horizontal slot 224 to the vertical slot 222, due to the longer distance between the horizontal slot 224 to the vertical slot 222, as shown in the chart 440.

FIGS. 5A through 5E are charts illustrating variations of S parameters of the antenna element 200 of FIG. 2, according to certain aspects of the disclosure. The S parameters referred to in the charts of FIG. 5A through 5E are scattering parameters including S11, S21, S12 and S22, which represent input reflection coefficient (S11) (also referred to as "return loss"), isolations between two feed ports (S21 and S12) and input reflection coefficient of the second port (S22). The S parameter values shown in the charts of FIG. 5A through 5E are results of simulation of an infinite array of antenna unit cells each having dimensions as shown in FIG. 3.

Figure 5A:
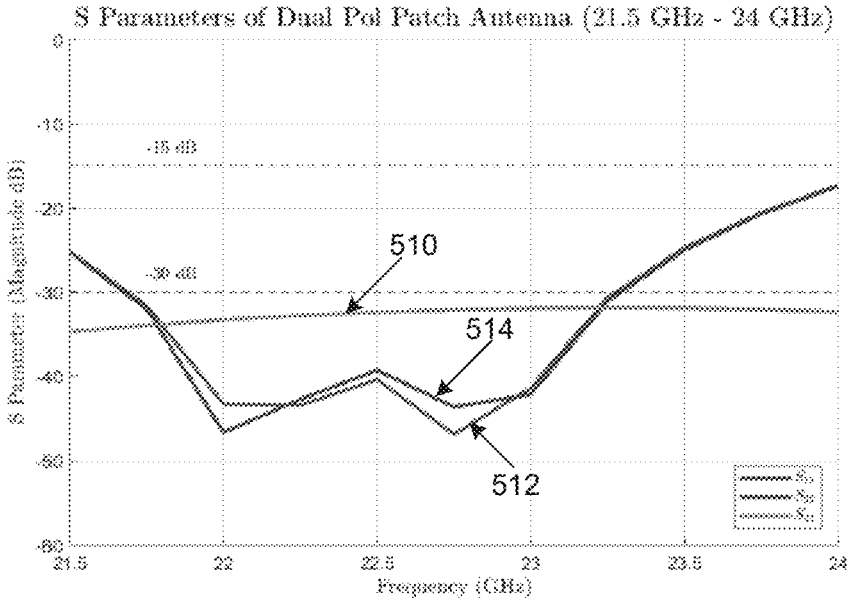
FIGS. 5A through 5E are charts illustrating variations of S parameters of the high-isolation dual-polarized aperture-coupled patch antenna element of FIG. 2, according to certain aspects of the disclosure.

The chart of FIG. 5A depicts S11, S22 and S21 parameters. For example, plots 510, 512 and 514 show variations of the isolation between feed ports (S21), input reflection coefficient of the second port (S22), and input reflection coefficient S11 versus frequency. The isolation between feed ports is better than −30 dB over the entire frequency range of 21.5-24 GHz. The reflection coefficient is better than −15 dB over the entire frequency range of 21.5-24 GHz. Variations of the reflection coefficients S11 and S22 shown by plots 514 and 512 closely follow one another as the frequency changes.

Figure 5B:
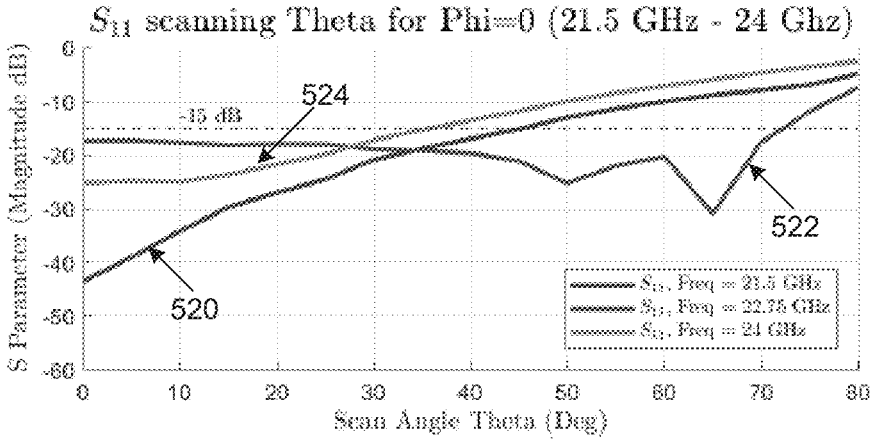

The chart of FIG. 5B depict variation of the input reflection coefficient (S11) versus scanning angle (theta) for different frequencies. For example, plots 520, 522 and 524 show variations with scanning angle of the input reflection coefficient at frequencies of 21.5, 22.75 and 24 GHz, respectively. The simulation results as depicted by these plots are for angle theta swept from 0 to 80 degrees, while the angle phi is kept constant at 0 degree. The values of the S11 parameter is better than −15 dB for theta<37 degrees.

Figure 5C:
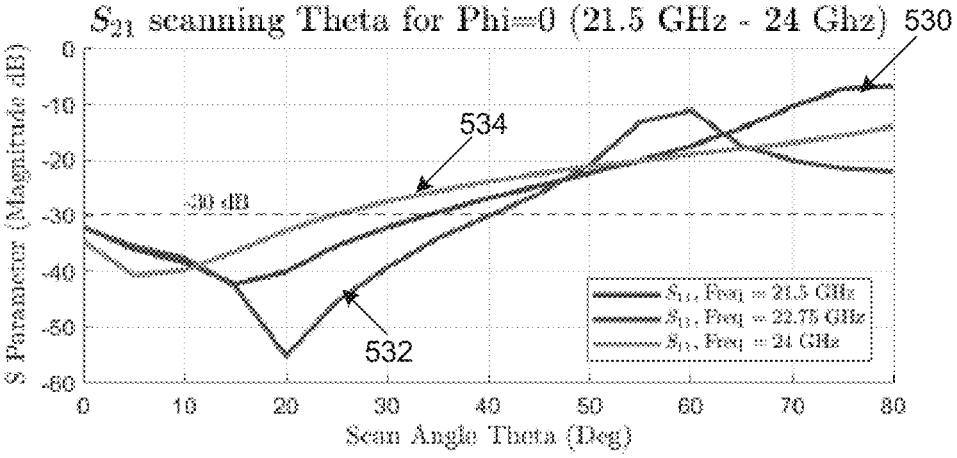

The chart of FIG. 5C depict variation of the isolation (S21) versus scanning angle (theta) for different frequencies. For example, plots 530, 532 and 534 show variations with scanning angle of the isolation at frequencies of 21.5, 22.75 and 24 GHz, respectively. The simulation results as depicted by these plots are for angle theta swept from 0 to 80 degrees, while the angle phi is kept constant at 0 degree. The values of the S21 parameter is better than −30 dB for theta<25 degrees.

Figure 5D:
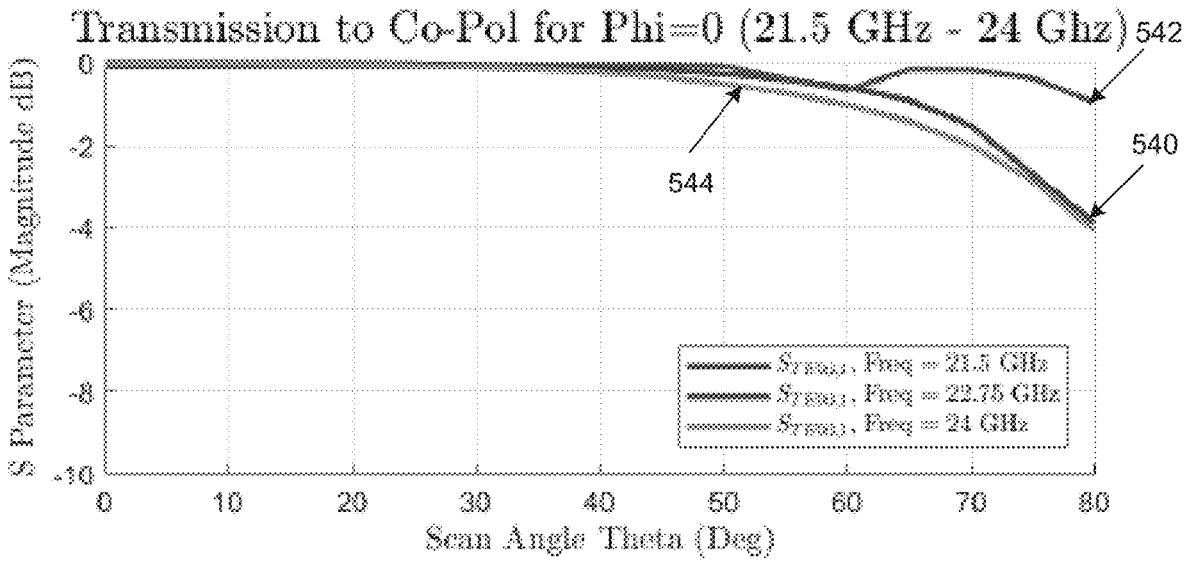

The chart of FIG. 5D depict the transmission to co-pol (e.g., similar polarizations) versus scanning angle (theta) for different frequencies. For example, plots 540, 542 and 544 show variations with scanning angle of the transmission to co-pol at frequencies of 21.5, 22.75 and 24 GHz, respectively. The simulation results as depicted by these plots are for angle theta swept from 0 to 80 degrees, while the angle phi is kept constant at 0 degree. The values of the transmission to co-pol parameter (e.g., $S1,_{TEOO}$) are better than −1 dB for theta<60 degrees.

Figure 5E:
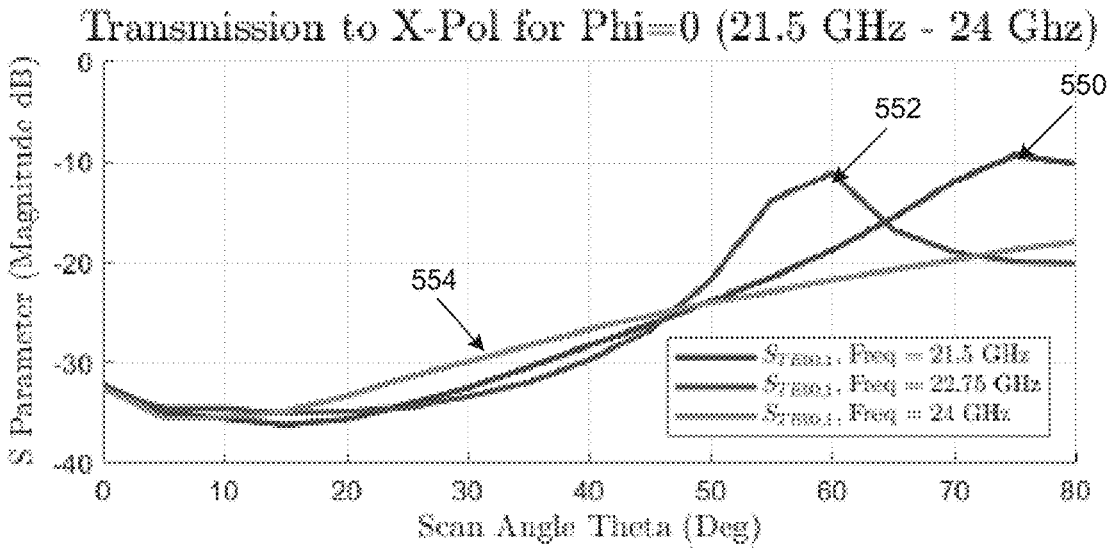

The chart of FIG. 5E depict the transmission to x-pol (e.g., cross-polarizations) versus scanning angle (theta) for different frequencies. For example, plots 550, 552 and 554 show variations with scanning angle of the transmission to x-pol at frequencies of 21.5, 22.75 and 24 GHz, respectively. The simulation results as depicted by these plots are for angle theta swept from 0 to 80 degrees, while the angle phi is kept constant at 0 degree. The values of the transmission to x-pol parameter (e.g., $S1_{,TMOO}$) are better than −30 dB for theta<30 degrees.

Figure 6:
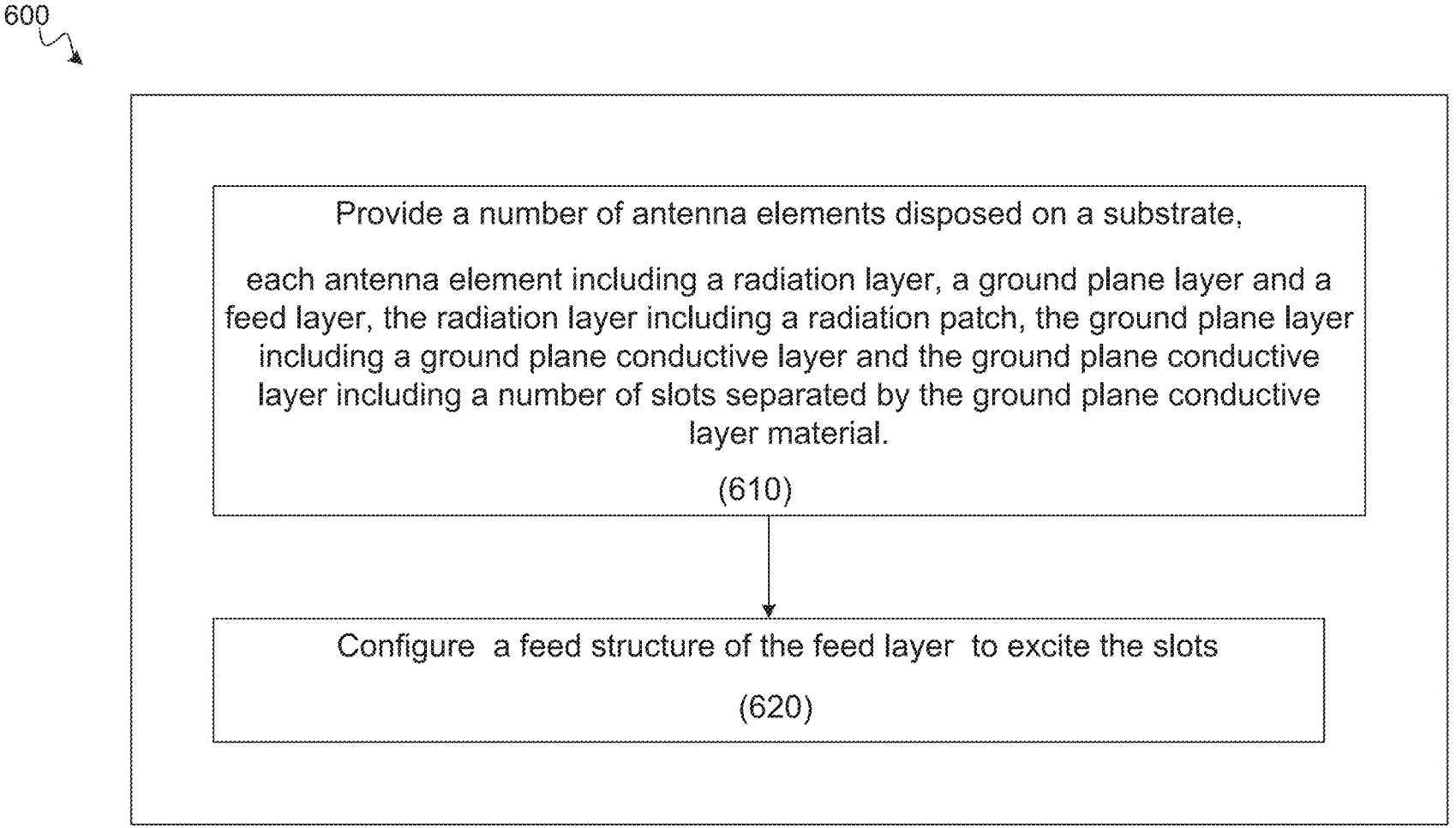
FIG. 6 is a flow diagram illustrating an example method of providing a dual-polarized patch antenna array according to some aspects of the subject technology.

FIG. 6 is a flow diagram illustrating an example method 600 of providing a dual-polarized patch antenna array (e.g., 100 of FIG. 1) according to some aspects of the subject technology. The method 600 includes providing a plurality of antenna elements (e.g., 110 of FIG. 1 or 200 of FIG. 2) disposed on a substrate (e.g., 206 of FIG. 2) (610). Each antenna element includes a radiation layer (e.g., above 205 of FIG. 2), a ground plane layer (e.g., 205 of FIG. 2) and a feed layer (e.g., 230 of FIG. 2). The radiation layer includes a radiation patch (e.g., 112 of FIG. 1), and the ground plane layer includes a ground plane conductive layer (e.g., 225 of FIG. 2). The ground plane conductive layer includes a number of slots (e.g., 222 and 224 of FIG. 2) separated by the ground plane conductive layer material. The feed layer includes a feed structure (e.g., including 232 and 234 of FIG. 2) that is configured to excite the slots (620). The slots realize the dual polarization feature of the dual-polarized patch antenna array.

Figure 7:
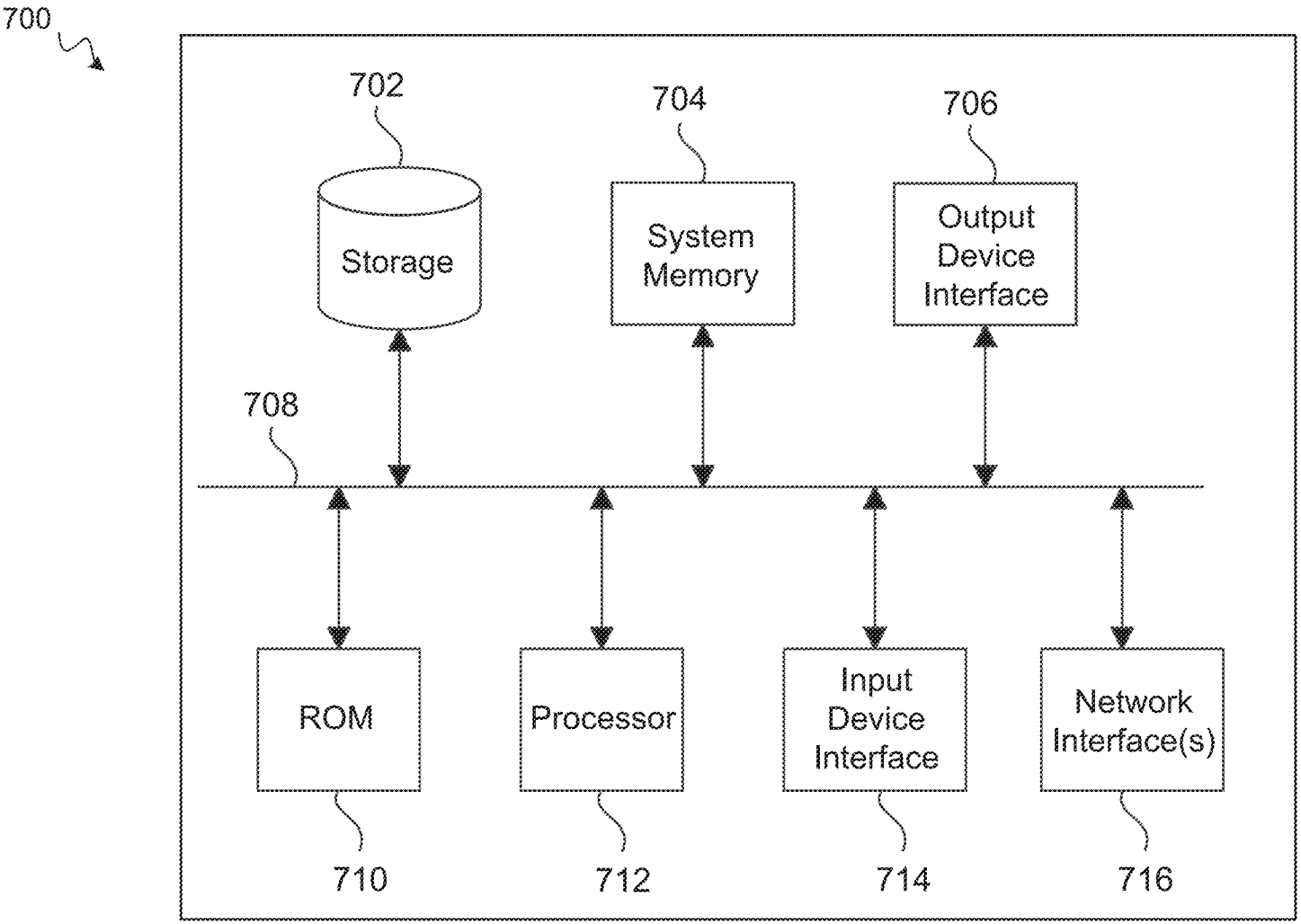
FIG. 7 is a block diagram conceptually illustrating an electronic system with which aspects of the subject technology are implemented.

FIG. 7 is a block diagram conceptually illustrating an electronic system 700 with which aspects of the subject technology are implemented. The electronic system 700 may be a server, a desktop or a laptop computer that can be employed to perform the simulations of the antenna array of the subject technology. The electronic system 700 includes a bus 708, one or more processing unit(s) 712, a system memory 704, a read-only memory (ROM) 710, a permanent storage device 702, an input device interface 714, an output device interface 706, and a network interface 716, or subsets and variations thereof.

The bus 708 collectively represents all system, peripheral, and chipset buses that communicatively connect the numerous internal devices of the electronic system 700. In one or more implementations, the bus 708 communicatively connects the one or more processing unit(s) 712 with the ROM 710, the system memory 704, and the permanent storage device 702. From these various memory units, the one or more processing unit(s) 712 retrieves instructions to execute and data to process in order to execute the processes of the subject disclosure. The one or more processing unit(s) 712 can be a single processor or a multi-core processor in different implementations. In some implementations, the one or more processing unit(s) 712 can be used to perform various simulations of the antenna array of the subject technology as shown in FIGS. 4A-4B and 5A through 5E.

The ROM 710 stores static data and instructions that are needed by the one or more processing unit(s) 712 and other modules of the electronic system. The permanent storage device 702, on the other hand, is a read-and-write memory device. The permanent storage device 702 is a non-volatile memory unit that stores instructions and data even when the electronic system 700 is off. One or more implementations of the subject disclosure use a mass-storage device (such as a magnetic or optical disk and its corresponding disk drive) as the permanent storage device 702.

Other implementations use a removable storage device (such as a floppy disk, flash drive, and its corresponding disk drive) as the permanent storage device 702. Like the permanent storage device 702, the system memory 704 is a read-and-write memory device. However, unlike the permanent storage device 702, the system memory 704 is a volatile read-and-write memory, such as a random access memory. System memory 704 stores any of the instructions and data that the one or more processing unit(s) 712 needs at runtime. In one or more implementations, the processes of the subject disclosure are stored in the system memory 704, the permanent storage device 702, and/or the ROM 710. From these various memory units, the one or more processing unit(s) 712 retrieves instructions to execute and data to process in order to execute the processes of one or more implementations.

The bus 708 also connects to the input device interface 714 and the output device interface 706. The input device interface 714 enables a user to communicate information and select commands to the electronic system. Input devices used with the input device interface 714 include, for example, alphanumeric keyboards and pointing devices (also called "cursor control devices"). The output device interface 706 enables, for example, the display of images generated by the electronic system 700. Output devices used with the output device interface 706 include, for example, printers and display devices, such as a liquid crystal display (LCD), a light emitting diode (LED) display, an organic light emitting diode (OLED) display, a flexible display, a flat panel display, a solid state display, a projector, or any other device for outputting information. One or more implementations may include devices that function as both input and output devices, such as a touchscreen. In these implementations, feedback provided to the user can be any form of sensory feedback, such as visual feedback, auditory feedback, or tactile feedback; and input from the user can be received in any form, including acoustic, speech, or tactile input.

Finally, as shown in FIG. 7, the bus 708 also couples the electronic system 700 to one or more networks (not shown) through one or more network interfaces 716. In this manner, the computer can be a part of one or more network of computers (such as a local area network ("LAN"), a wide area network ("WAN"), or an Intranet, or a network of networks, such as the Internet). Any or all components of the electronic system 700 can be used in conjunction with the subject disclosure.

Implementations within the scope of the present disclosure can be partially or entirely realized using a tangible computer-readable storage medium (or multiple tangible computer-readable storage media of one or more types) encoding one or more instructions. The tangible computer-readable storage medium also can be non-transitory in nature.

The computer-readable storage medium can be any storage medium that can be read, written, or otherwise accessed by a general purpose or special purpose computing device, including any processing electronics and/or processing circuitry capable of executing instructions. For example, without limitation, the computer-readable medium can include any volatile semiconductor memory, such as RAM, DRAM, SRAM, T-RAM, Z-RAM, and TTRAM. The computer-readable medium also can include any non-volatile semiconductor memory, such as ROM, PROM, EPROM, EEPROM, NVRAM, flash, nvSRAM, FeRAM, FeTRAM, MRAM, PRAM, CBRAM, SONOS, RRAM, NRAM, racetrack memory, FJG, and Millipede memory.

Further, the computer-readable storage medium can include any non-semiconductor memory, such as optical disk storage, magnetic disk storage, magnetic tape, other magnetic storage devices, or any other medium capable of storing one or more instructions. In some implementations, the tangible computer-readable storage medium can be directly coupled to a computing device, while in other implementations, the tangible computer-readable storage medium can be indirectly coupled to a computing device, e.g., via one or more wired connections, one or more wireless connections, or any combination thereof.

Instructions can be directly executable or can be used to develop executable instructions. For example, instructions can be realized as executable or non-executable machine code or as instructions in a high-level language that can be compiled to produce executable or non-executable machine code. Further, instructions also can be realized as or can include data. Computer-executable instructions also can be organized in any format, including routines, subroutines, programs, data structures, objects, modules, applications, applets, functions, etc. As recognized by those of skill in the art, details including, but not limited to, the number, structure, sequence, and organization of instructions can vary significantly without varying the underlying logic, function, processing, and output.

While the above discussion primarily refers to microprocessor or multi-core processors that execute software, one or more implementations are performed by one or more integrated circuits, such as application specific integrated circuits (ASICs) or field programmable gate arrays (FPGAs). In one or more implementations, such integrated circuits execute instructions that are stored on the circuit itself.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

As used in this specification and any claims of this application, the terms "base station," "receiver," "computer," "server," "processor," and "memory" all refer to electronic or other technological devices. These terms exclude people or groups of people. For the purposes of the specification, the terms "display" or "displaying" means displaying on an electronic device.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. An antenna system comprising:

an antenna array comprising a plurality of antenna elements disposed on a substrate, each antenna element comprising:

a radiation layer comprising a radiation patch;

a ground plane layer comprising a ground plane conductive layer having a plurality of slots; and a feed layer comprising a feed structure configured to excite the plurality of slots, wherein:

the ground plane layer forms a bottom layer of the antenna element, the antenna array comprises a dual polarization including a vertical polarization and a horizontal polarization realized via the plurality of slots, and the plurality of slots are separated by the ground plane conductive layer and extend to edges of the ground plane conductive layer to join respective slots of neighboring antenna elements of the antenna array.

2. The antenna system of claim 1, wherein the plurality of slots comprise two sets of orthogonal slots extending edges of the ground plane conductive layer.

3. The antenna system of claim 2, wherein the two sets of orthogonal slots are symmetric.

4. The antenna system of claim 2, wherein the two sets of orthogonal slots are positioned with an offset with respect to a middle point of the radiation patch, wherein the offset is about 0.5 mm.

5. The antenna system of claim 2, wherein the ground plane layer is realized over the feed layer, and wherein the feed layer comprises the feed structure including two stripline feeds.

6. The antenna system of claim 5, wherein each stripline feed is configured to feed a set of the two sets of orthogonal slots, and wherein the feed structure is formed on a bottom surface of the substrate.

7. The antenna system of claim 1, wherein the antenna array comprises more than 100 antenna elements, and wherein each antenna element has dimensions of an order of a few mm.

8. The antenna system of claim 1, wherein the substrate comprises a low-loss dielectric material with a relative permittivity of about 2.2.

9. The antenna system of claim 8, wherein the antenna array is configured to operate within a frequency range of about 21.5-24 GHz, and wherein an isolation between ports of the antenna array is better than 30 dB within the frequency range of about 21.5-24 GHz.

10. The antenna system of claim 9, wherein the antenna array is configured to provide a return loss better than 15 dB within a wide scan angle of about 70 degrees spanning a range of about −35 to +35 degrees.

11. An antenna unit cell comprising:

a radiation layer comprising a radiation patch configured to propagate radio-frequency (RF) radiation;

a ground plane layer comprising a first ground plane conductive layer including two sets of slots separated by the first ground plane conductive layer and extending to edges of antenna unit cell to join respective slots of neighboring antenna elements of an antenna array;

a feed layer comprising a feed structure configured to separately excite the two sets of slots; and an additional ground plane layer comprising a second ground plane conductive layer, wherein:

the two sets of slots are configured to realize a dual polarization feature of the antenna unit cell, the dual polarization feature includes a vertical polarization and a horizontal polarization, and the two sets of slots are symmetrically positioned on the ground plane layer.

12. The antenna unit cell of claim 11, wherein the two sets of slots are orthogonal.

13. The antenna unit cell of claim 11, wherein each of the two sets of slots has an offset with respect to a middle point of the radiation patch, and wherein the offset is less than 1 mm.

14. The antenna unit cell of claim 11, wherein the feed structure comprises two asymmetrical feed patches and each of the two asymmetrical feed patches is configured to excite one set of the two sets of slots.

15. The antenna unit cell of claim 11, wherein an isolation between two polarizations created by the two sets of slots is better than 30 dB when operating within a frequency range of about 21.5-24 GHz.

16. The antenna unit cell of claim 11, wherein a return loss of ports of the antenna unit cell is better than 15 dB when used in an antenna array scanning a wide angle of about 70 degrees from about −35 to +35 degrees.

17. A method of providing a dual-polarized patch antenna array, the method comprising:

providing a plurality of antenna elements disposed on a substrate, each antenna element comprising:

a radiation layer comprising a radiation patch;

a ground plane layer comprising a ground plane conductive layer having a plurality of slots separated by the ground plane conductive layer and extending to edges of the first ground plane conductive layer to join respective slots of neighboring antenna elements of the plurality of antenna elements; and a feed layer comprising a feed structure; and configuring the feed structure to excite the plurality of slots, wherein a dual polarization feature of the dual-polarized patch antenna array is realized via the plurality of slots, and wherein the dual polarization feature includes a vertical polarization and a horizontal polarization.

18. The method of claim 17, further comprising an additional ground plane layer, wherein the plurality of slots comprise two symmetric sets of orthogonal slots.

19. The method of claim 18, wherein the feed structure comprises two asymmetrical feed patches, and wherein each feed patch is configured to feed a set of the two symmetric sets of orthogonal slots.

20. The method of claim 17, wherein the substrate comprises a low-loss dielectric material including a duroid material, and wherein the dual-polarized patch antenna array is configured to operate within a frequency range of about 21.5-24 GHz with an isolation between ports of the plurality of the antenna elements being better than 30 dB.

* * * * *